US007285011B2

(12) United States Patent
Hardy et al.

(10) Patent No.: US 7,285,011 B2
(45) Date of Patent: Oct. 23, 2007

(54) CABLE EXIT FOR AN ELECTRICAL CONNECTOR ASSEMBLY

(75) Inventors: Douglas J Hardy, Middletown, PA (US); John W Hall, Harrisburg, PA (US); John M. Myer, Millersville, PA (US); James Raudenbush, Halifax, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/257,334

(22) Filed: Oct. 24, 2005

(65) Prior Publication Data

US 2007/0093120 A1 Apr. 26, 2007

(51) Int. Cl.
*H01R 9/05* (2006.01)

(52) U.S. Cl. ..... 439/582; 439/694; 439/881

(58) Field of Classification Search ..... 439/881, 439/855, 902, 694, 582, 468, 11, 466
See application file for complete search history.

(56) References Cited

U.S. PATENT DOCUMENTS 1,984,181 A * 12/1934 French ..... 439/694
4,501,459 A 2/1985 Chandler et al.
5,271,739 A * 12/1993 Denlinger et al. ..... 439/466
5,882,226 A * 3/1999 Bell et al. ..... 439/582
6,371,795 B1 * 4/2002 Yamamoto et al. ..... 439/468
6,676,445 B2 1/2004 Hall et al.
6,824,403 B2 11/2004 Hall et al.
7,044,786 B2 * 5/2006 Nimura ..... 439/587

FOREIGN PATENT DOCUMENTS

WO WO 82/03296 * 9/1982

* cited by examiner

*Primary Examiner*—Tho D. Ta

(57) ABSTRACT

A coaxial plug assembly is shown provided with a main housing which houses a coaxial plug connector. A retention housing is provided which latches to the main housing and which retains the coaxial connector in place. In some embodiments, the retention housing includes an integral locking plate to which a cable exit member can be attached for orienting the cable exit in a 90° angle exit relative to the coaxial connector. In another embodiment a locking plate is integrally attached to the coaxial cable sleeve and includes a cable exit portion which is latchingly connected to the locking part.

20 Claims, 23 Drawing Sheets

CABLE EXIT FOR AN ELECTRICAL CONNECTOR ASSEMBLY

BACKGROUND OF THE INVENTION

The present invention relates generally to electrical connectors and, more particularly, to a cable exit assembly for a coaxial cable connector assembly.

Radio frequency (RF) coaxial cable connector assemblies have been used for numerous automotive applications, such as global positioning systems (GPS), car radios, mobile phones, air bag systems, and multimedia devices. Coaxial cables typically consist of an outer conductor, an inner conductor, a dielectric, and a jacket. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference herein.

In order to standardize various types of connectors and thereby avoid confusion, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

Certain automotive applications may require that coaxial cables be installed with a 90° bend, for example in the case of an installation at the rear of a dashboard. Typically, these electrical connector assemblies include a heavy brass sleeve or ferrule which crimps onto the cable with an exit eyelet attached to the ferrule. The ferrule is positioned at a 90° bend relative to the connector, and the cable is routed through the ferrule. In such applications, a heavy crimping die is used which makes the assembly of the cable connectors difficult and labor intensive.

SUMMARY OF THE INVENTION

According to an illustrative embodiment of the current disclosure, an electrical connector assembly for interconnection to a cable, comprises an insulating housing assembly having a front mating face and a conductor receiving face. A locking plate is adjacent to the conductor receiving face. A cable exit member is provided which is profiled to re-direct the cable to an angle other than an exit angle at the conductor receiving face, with the cable exit member being attachable to the locking plate.

According to a further illustrative embodiment of the disclosure, an electrical connector assembly for interconnection to a cable, comprises an insulating housing assembly having a front mating face and a conductor receiving face. A locking plate is attached to the housing assembly adjacent to the conductor receiving face, and a cable exit member is attached to the locking plate and profiled to re-direct the cable in multiple angular exit orientations.

DESCRIPTION OF INVENTION

Figure 1:
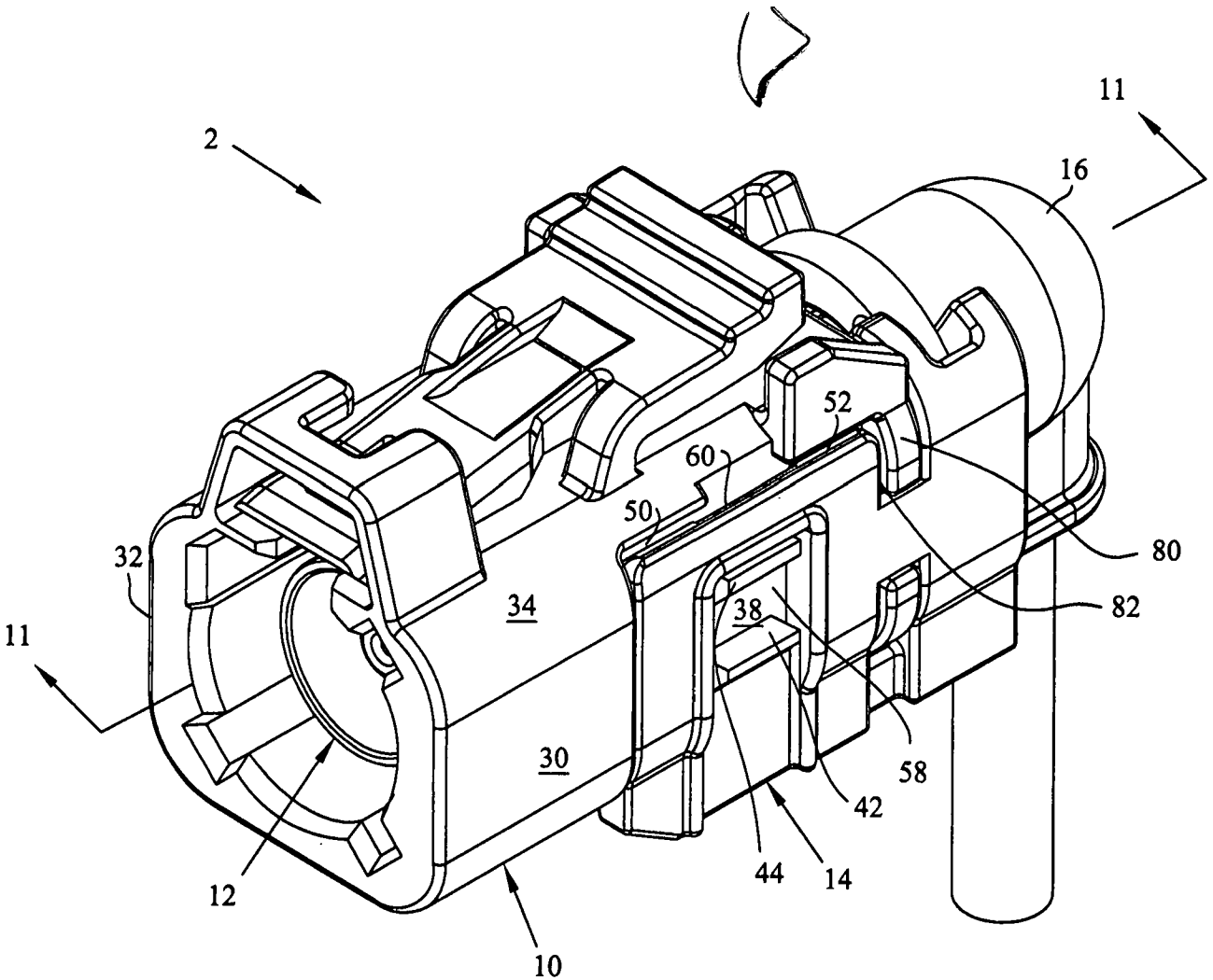
FIG. 1 is a front perspective view of the coaxial plug assembly of the present embodiment.
Figure 2:
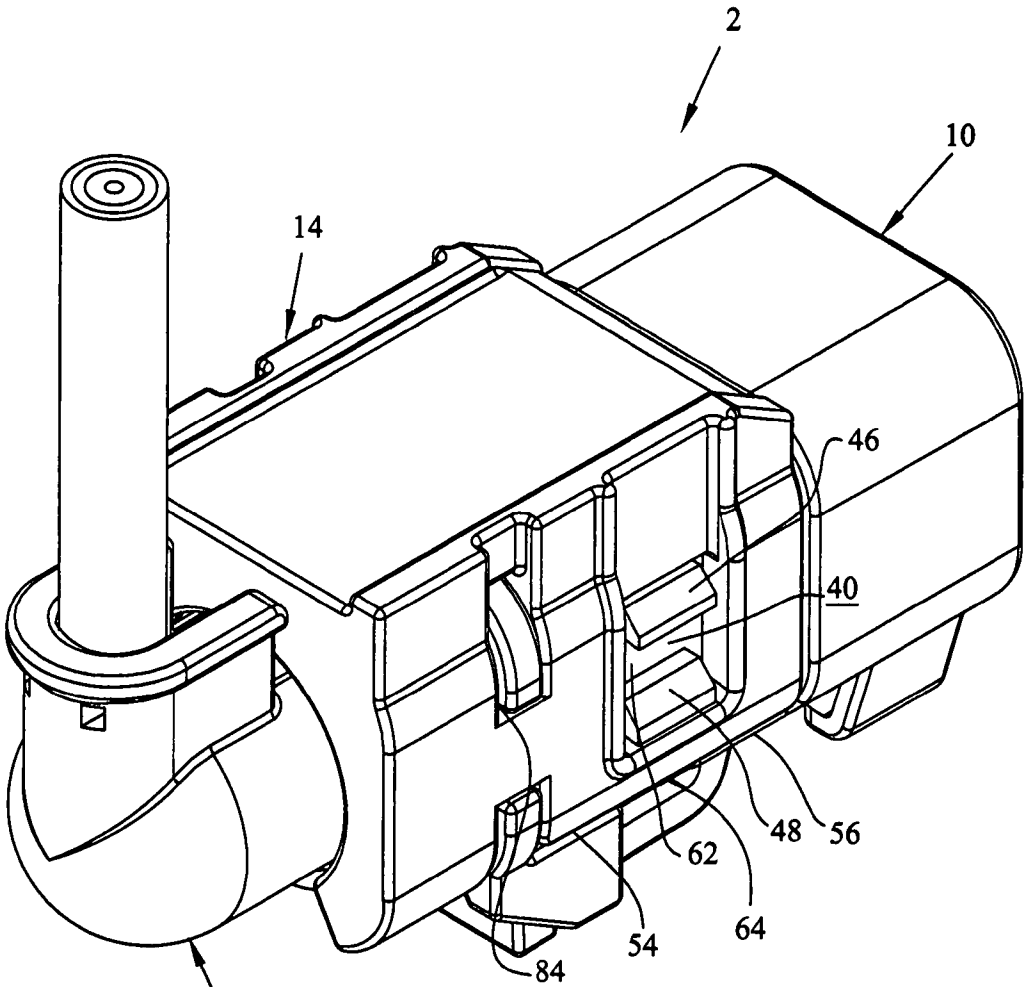
FIG. 2 is an underside perspective of the embodiment of FIG. 1.

With reference first to FIGS. 1-2, the coaxial plug assembly is shown generally at 2 which includes a main housing portion 10, a coaxial plug connector shown generally at 12, a retention housing 14, and finally includes a cable exit member shown at 16. It should be generally understood that the main housing portion 10 houses and retains coaxial plug connector 12; retention housing 14 provides the primary contact locking to coaxial plug connector 12; and the cable exit member 16 orients a coaxial cable at a 90° exit angle relative to the longitudinal axis of the coaxial plug assembly 2.

Figure 3:
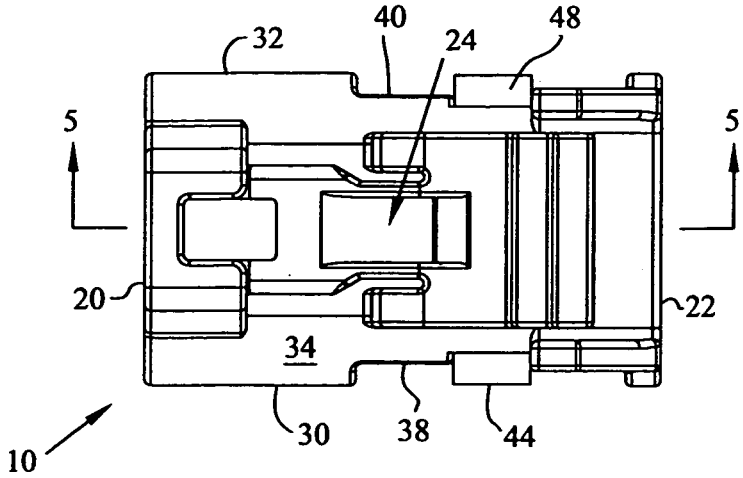
FIGS. 3 and 4 show upper and lower plan views of the main housing portion of the present embodiment respectively.
Figure 4:
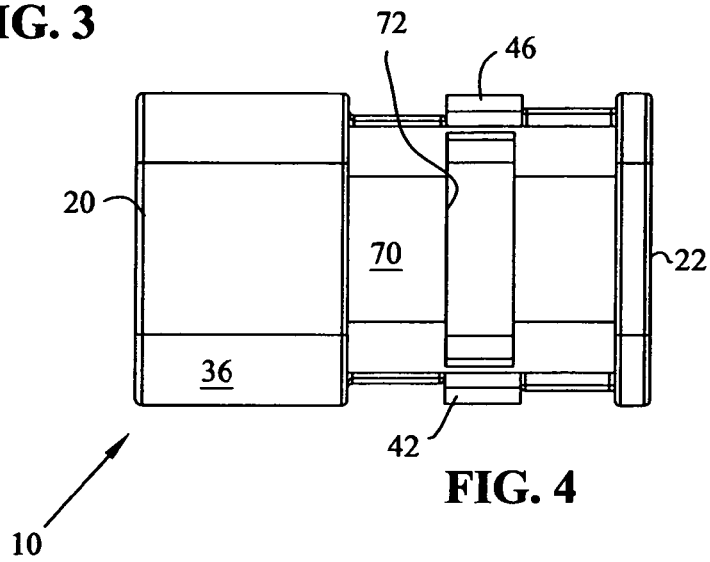
Figure 5:
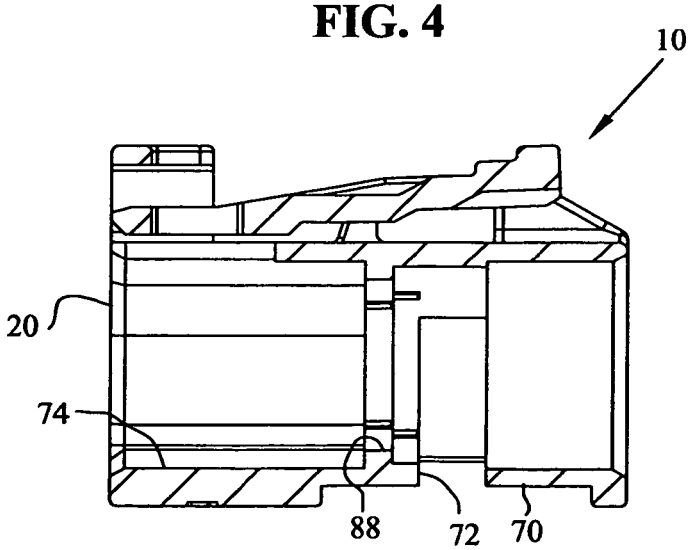
FIG. 5 is a cross-sectional view through lines 5-5 of FIG. 3.

With reference now to FIGS. 3-5, the main housing portion will be described in greater detail. Main housing portion 10 generally includes a front mating face 20 and a rear housing portion 22, which defines a conductor receiving face. A latch assembly 24 is provided to latchingly engage the plug connector with a mating jack connector as is well known in the art. Housing 10 generally comprises a rectangular configuration comprised of sidewalls 30 and 32, a top wall 34 and a lower wall 36. As shown, side walls 30 and 32 include pairs of flat wall portions 38 and 40 which include first and second latch portions 42, 44; and 46, 48. This defines linear flat receiving sections 50, 52 and 54, 56; (FIGS. 1 and 2) and transverse receiving sections 58, 60 and 62, 64 (FIGS. 1 and 2) as will be described further herein.

Lower wall 36 is also shown to include a flat wall portion 70 (FIG. 4) which includes a transverse slot 72 which communicates with an interior cavity portion 74 of the main housing portion 10 as best shown in FIG. 5. As best shown in FIGS. 1 and 2, rear housing portion 22 of main housing 10 also includes an annular ring 80 extending substantially around the periphery of the main housing 10 and includes an interruption at 82 and 84 to define latching openings. Finally as best shown in FIG. 5, main housing portion 10 includes an inner annular ring 88 defines a stop member as will be described further herein.

Figure 6:
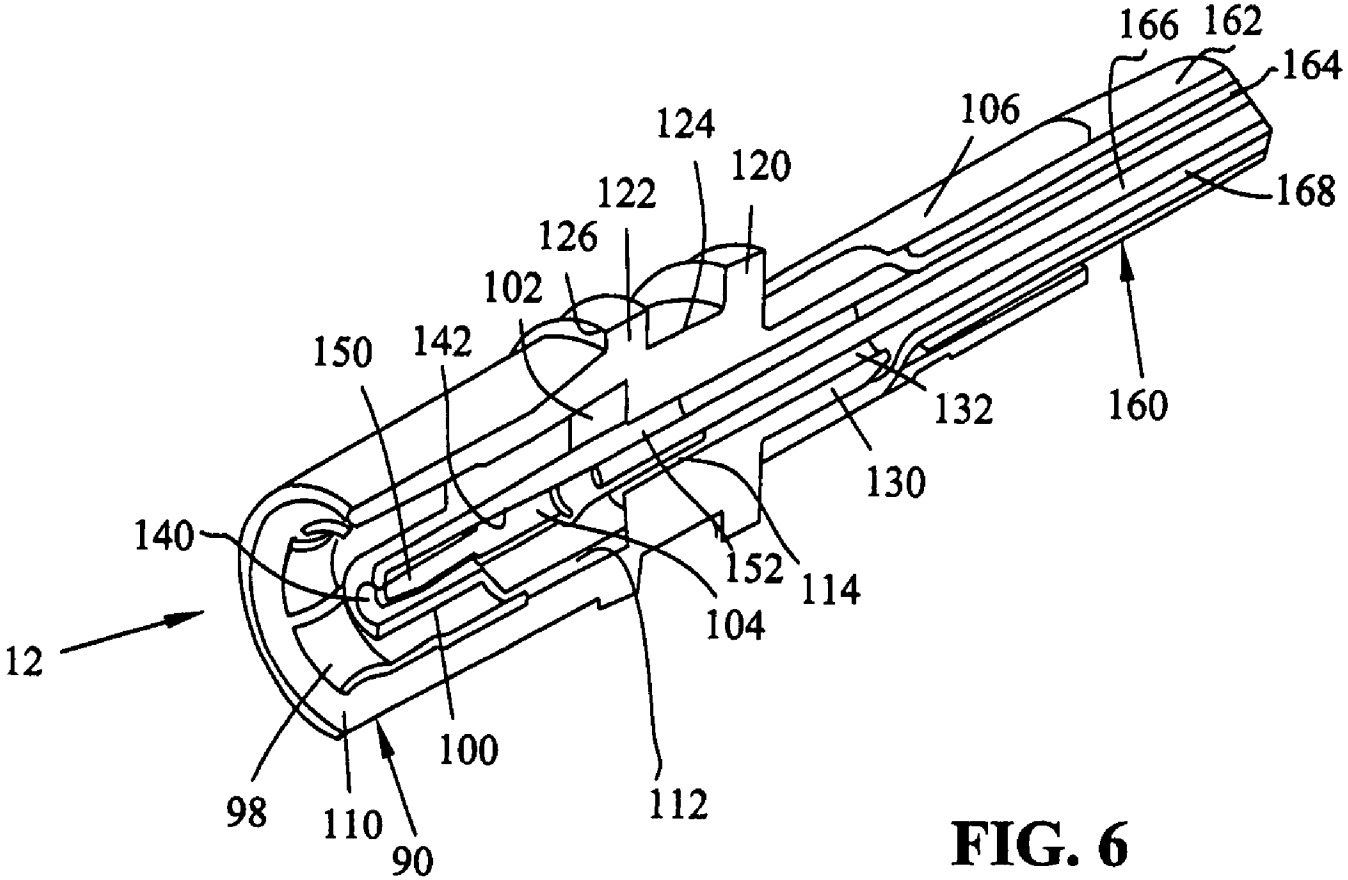
FIG. 6 is a cross-sectional view through the coaxial plug connector and cable of the present embodiment.

With respect now to FIG. 6, the coaxial plug connector 12 will be described in greater detail. The coaxial plug connector 12 includes an outer shell 90, an outer conductor 98, a dielectric 100, a locking ring 102, an inner conductor 104 and crimp ferrule 106. As shown, outer shell portion 90 includes a front conductor receiving section 110 for receiving the outer conductor 98 and extends rearwardly to a reduced diameter section 112 which extends rearwardly to a conductor receiving aperture 114. The outer surface of outer shell 90 includes two annular rings 120 and 122 which defines therebetween a locking surface as will be described herein. Ring 122 also defines a forwardly facing stop surface at 126. Finally shell 90 includes a rear sleeve portion 130 having a receiving aperture 132 there through which receives the coaxial cable as described further herein. Dielectric 100 includes a front pin receiving opening at 140 which communicates with an inner conductor receiving aperture 142. Inner conductor 104 includes a front contact section 150 and a rear wire crimp section 152.

It should be appreciated that the coaxial plug connector 12 as described above can be terminated to a coaxial cable 160 where the coaxial cable includes an outer insulation 162, an outer conductor or braid 164, inner conductor 166, and dielectric 168. As shown, conductor 166 is crimped to rear wire crimp 152 and the outer conductor 164 is dressed over rear sleeve 130 and crimped by crimp ferrule 106.

Figure 8:
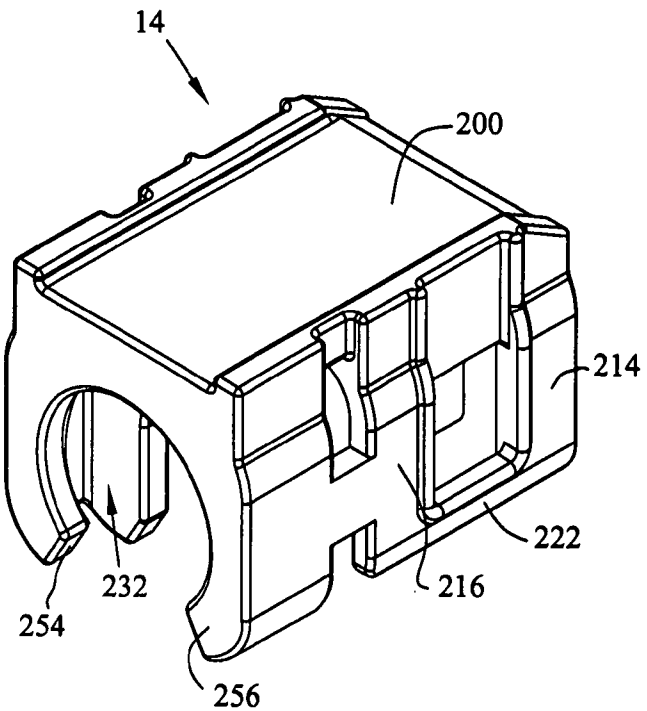
FIG. 8 is a lower perspective view of the retention housing of FIG. 7.
Figure 7:
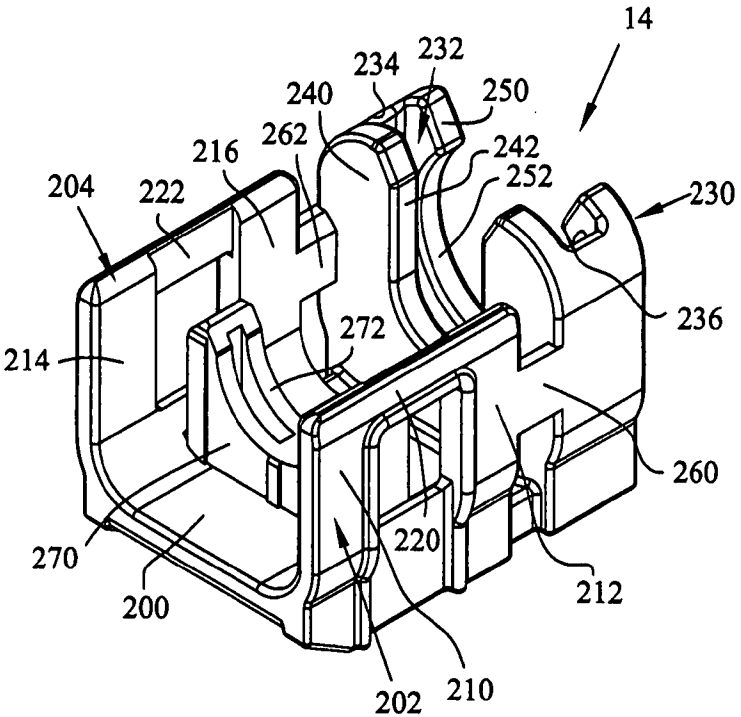
FIG. 7 is a top perspective view of the retention housing of the present embodiment.
Figure 11:
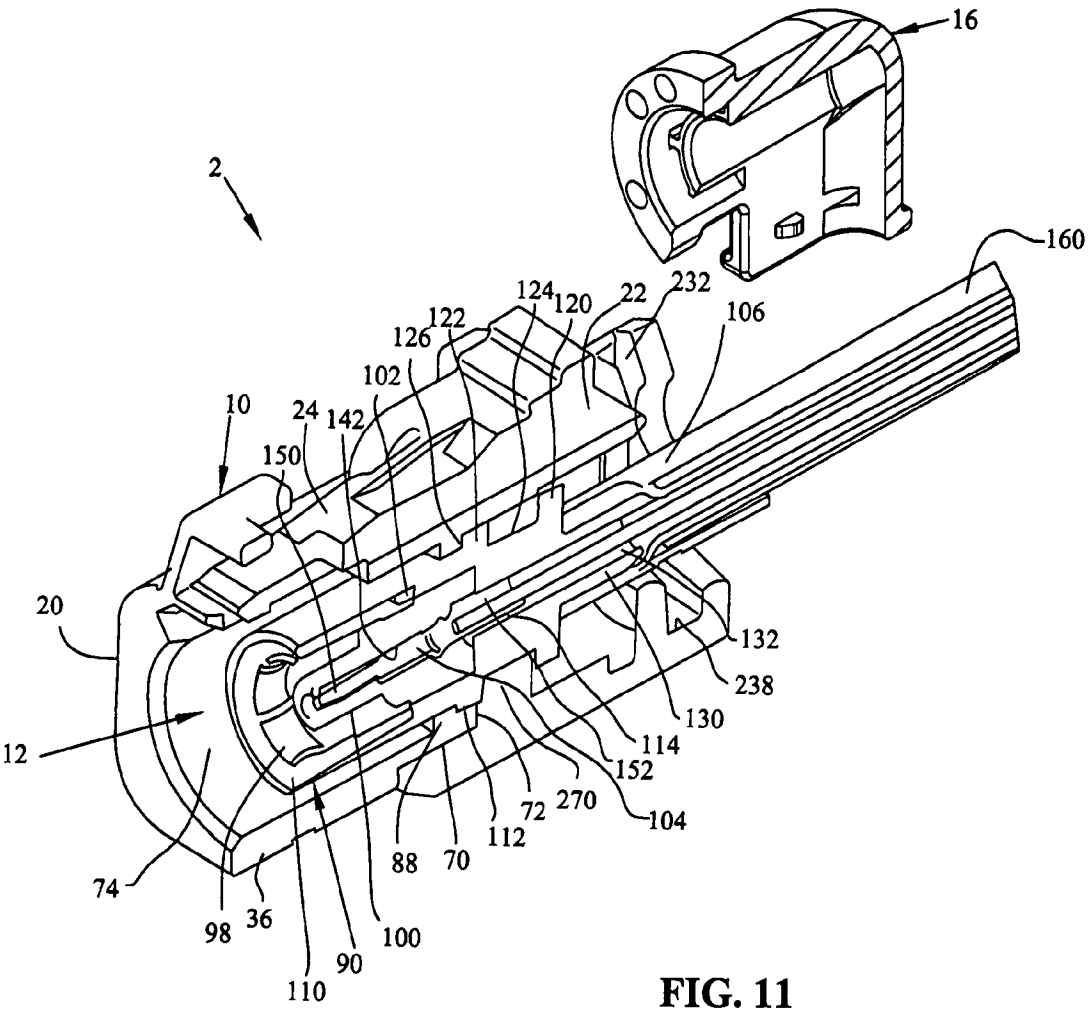
FIG. 11 is a cross sectional view through 11-11 of FIG. 1, with the cable exit member poised for receipt.

With reference now to FIGS. 7 and 8, the retention housing 14 generally comprises a lower wall section 200 having upstanding wall sections 202 and 204. Wall sections 202 and 204 generally include vertical wall section 210, 212; and 214, 216 and transverse latching straps 220 and to 222. A rear locking plate portion 230 extends inwardly from the retention housing and includes a U-shaped channel 232 defined generally by inner side wall surfaces 234 and 236 which extend downwardly to a radiused section 238 (FIG. 11). U-shaped channel 232 defines an inner wall portion 240 having a U-shaped slot 242 and a rear wall portion 250 having a generally cylindrical shaped opening 252 which terminates towards a top side thereof and defines lead-in surfaces 254, 256 (FIG. 8) as further described herein. Wall sections 202, 204 are connected to the locking plate portion 230 by way of latching straps 260 and 262. Finally, as shown best in FIG. 7 the retention housing 14 further comprises a terminal locking mechanism 270 upstanding from wall 200 which includes a semi-circular locking surface 272.

Figure 9:
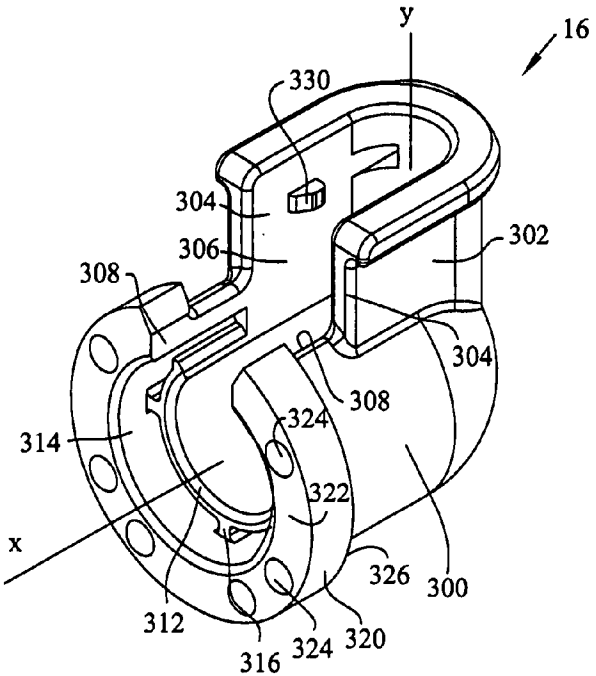
FIGS. 9 and 10 show perspective views of the cable exit member of the embodiment of FIG. 1.
Figure 10:
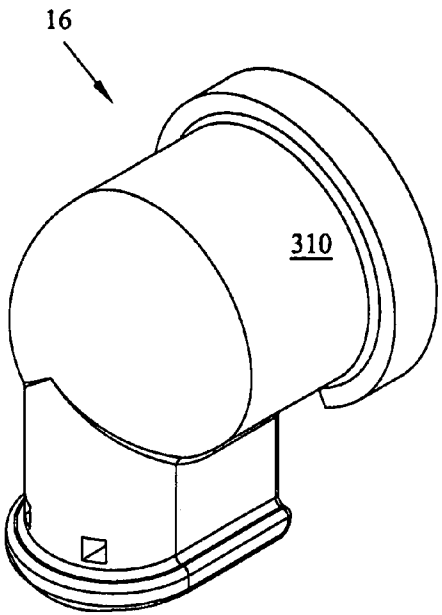

With respect now to FIGS. 9 and 10 the cable exit member 16 will be described in greater detail. The cable exit member 16 is generally defined as an elbow-shaped member having a generally right angular disposition defining an X and Y axis. The cable exit member 16 includes a dome shaped section 300 and exit sleeve 302. As best shown in FIG. 9, exit sleeve 302 has open walls 304 defining a cable slot 306. The cable slot 306 is continuous through the dome shaped portion 300 defining inner side walls 308. Dome shaped section 300 further includes an outer surface 310 of a generally circular cross sectional configuration as will described further herein. As best shown in FIG. 9, dome shaped section 300 includes an inner wall portion 312 separated from an outer wall portion 314 by way of ribs 316. Dome shaped section 300 further includes an outer flange portion 320 having a front face 322 having a plurality of dimples at 324, and flange portion 320 having a rear face 326. Finally, as also shown in FIG. 9, exit sleeve 302 includes an inner detent portion at 330.

With the elements as described above the assembly of the connector will be described as follows. With reference first to FIGS. 1 and 2 it should be appreciated that the retention housing 14 has a preliminary position where transverse latching straps 220 and 222 are positioned intermediate latch portions 42 and 44; 46 48, which also positions the terminal locking mechanism 270 in a position allowing entry of the coaxial plug connector 12 all the way forward to the position shown where annular ring 122 abuts annular ring 88 of main housing portion 10. When in this position, retention housing 14 can be snapped further upward (in the sense of FIG. 1) which positions locking mechanism 270 adjacent the locking surface 124 holding the coaxial cable in position, as best shown in FIG. 12.

Figure 12:
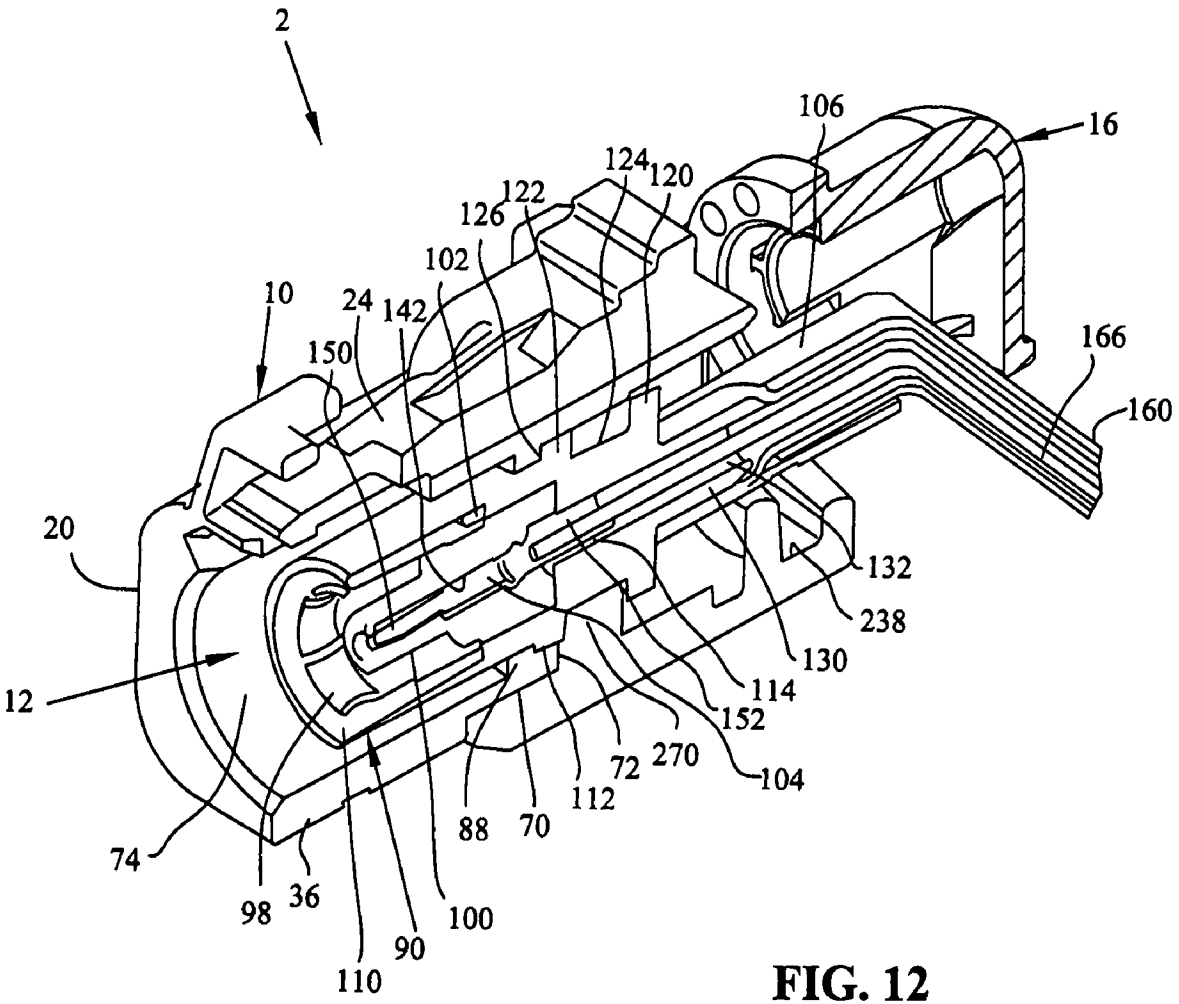
FIG. 12 shows a view similar to that of FIG. 11 showing the cable exit member in a partially received position, which begins to push against the coaxial cable.

As also shown in FIG. 12, cable exit member 16 can now be slidely received into U-shaped channel 232 (FIG. 7), and cable 160 is received in the right angular slot defined by cable slot 306 (FIG. 9). It should be appreciated from a review of FIGS. 7-10, that flange 320 is profiled with a diameter to be received within channel 232, and where the diameter of flange 320 is substantially complementary to radiused section 238 (FIG. 13) such that the entire flange 320 can be received in channel 232. It should also be appreciated from FIG. 7 that U-shaped slot 242 is substantially profiled to receive the coaxial cable 160 and ferrule 106 of the coaxial plug connector 12.

It should be further appreciated that the outer surface 310 (FIG. 10) of the domed-shaped section 300 is profiled with a diameter larger than the diameter of cylindrical shaped opening 252, (FIG. 7) such that an interference is provided between outer surface 310 and the lead-in surfaces 254, 256 (FIG. 8). That is, when the domed-shaped section 300 gets to the position shown in FIG. 12, the cable exit member must be slightly forced downwardly to snap beyond lead-in surfaces 254, 256 to be received in the cylindrical shaped opening 252. It should also be appreciated that, given the geometry of the cable slot 306 that the cable exit member 16 is easily added to the connector assembly after the termination of the coaxial plug, and after the locking of the coaxial plug connector 12 within its housing.

It should also be appreciated that the thickness of the flange, that is, the distance between faces 322 and 326 (FIG.

9) is less than the thickness of channel 232. However dimples 324 add to the thickness of the flange and provide a bearing engagement against the inner surface of the channel 232 to provide a resistance to its rotation. However it should also be profiled that the interference is specifically designed to allow the rotation of the cable exit member 16 which rotates the cable and the contact altogether.

Thus, as shown in FIG. 11, cable exit member 16 can now be added to the connector assembly. After the termination of the coaxial cable 160 to coaxial plug connector 12, coaxial plug connector 12 is placed in main housing 10, and then retention housing 14 is moved transversely into main housing portion 10. As shown in FIG. 11, the cable exit member 16 can now be moved downwardly such that the flange 320 is received in the channel 232. As the cable exit member 16 is moved downwardly, the cable exit member 16 begins to move cable 160 downwardly as shown in FIG. 12. Finally, as shown in FIG. 13, the cable exit member 16 is fully seated, with the coaxial cable 160 exiting at 90° relative to the longitudinal axis of the coaxial plug assembly 2.

Figure 13:
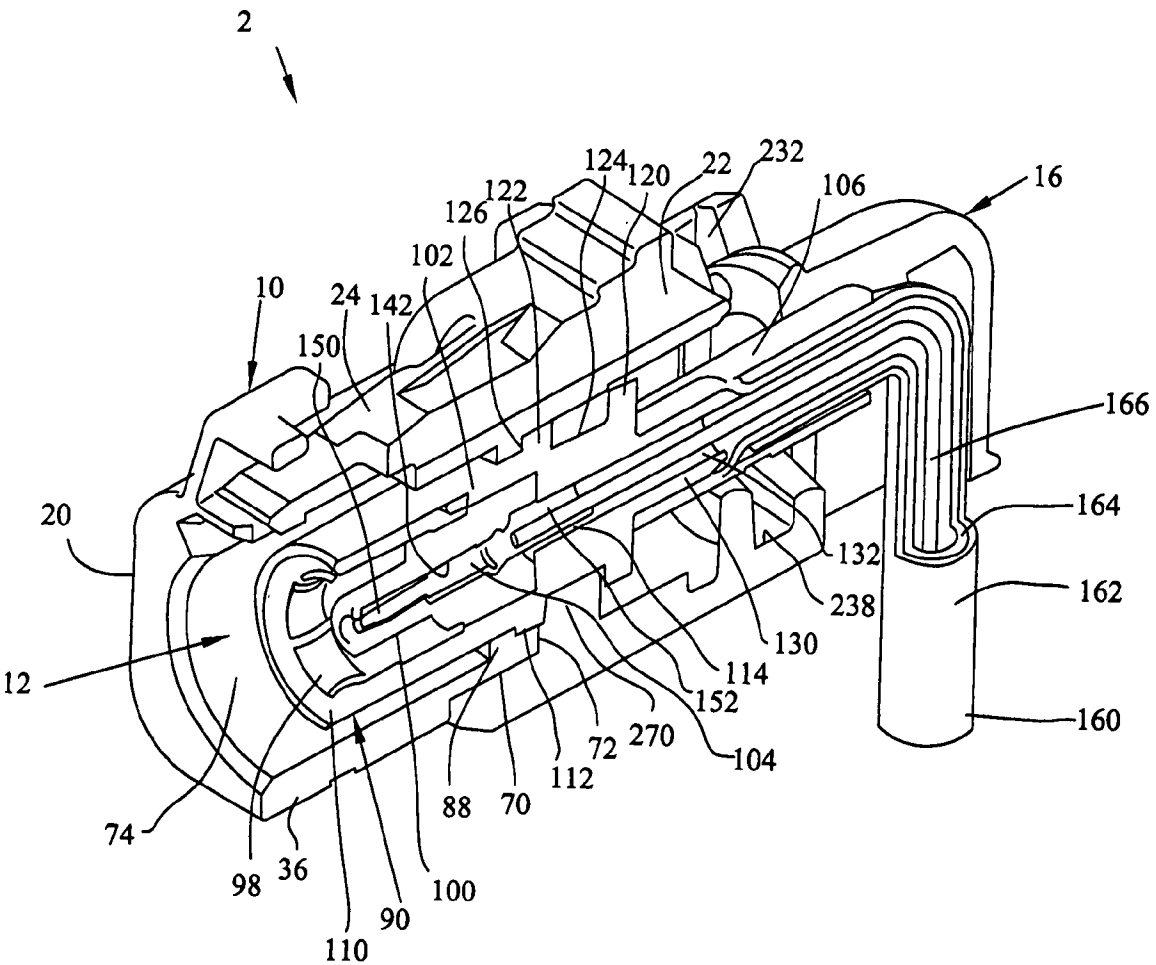
FIG. 13 shows the cable assembly in the fully assembled condition.
Figure 14:
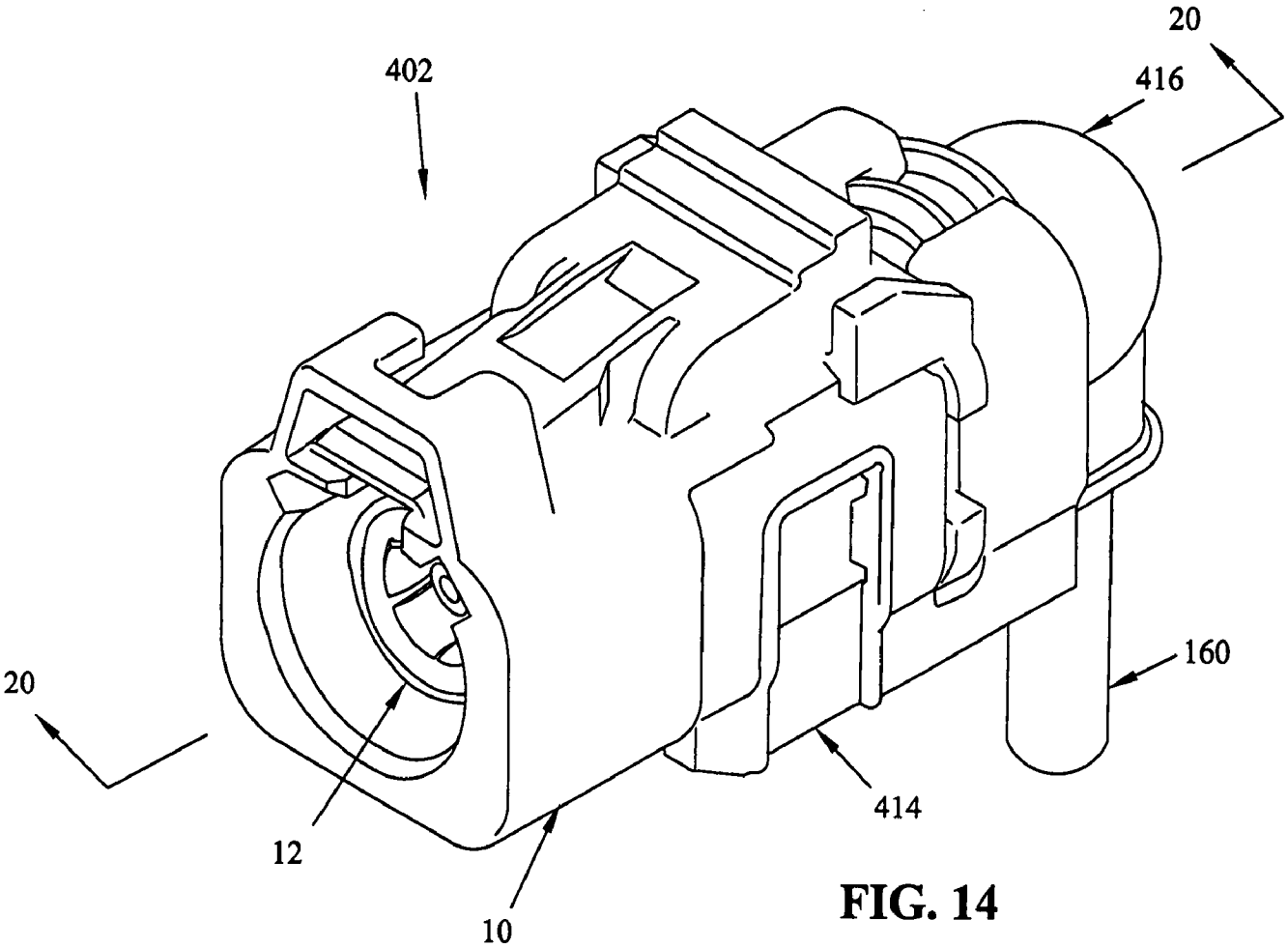
FIG. 14 is a top perspective view of a second embodiment of the connector assembly.
Figure 15:
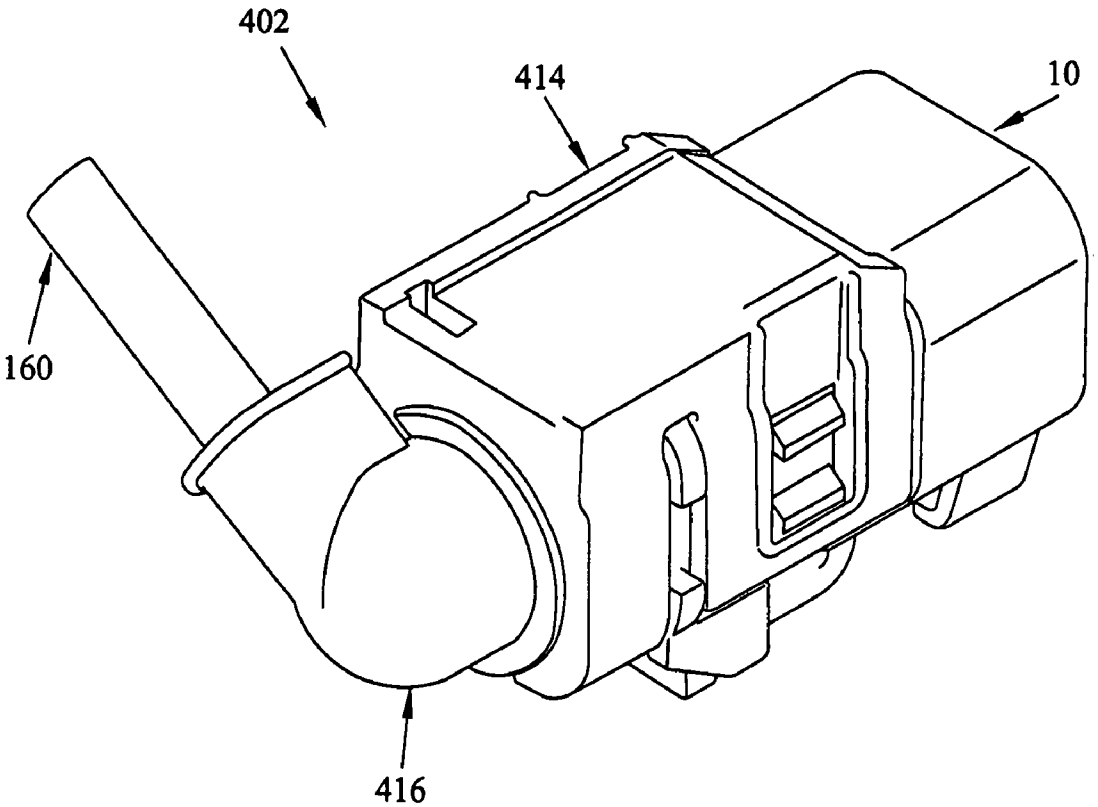
FIG. 15 is a lower perspective view of the embodiment of FIG. 14.

Advantageously, the above embodiment provides an easy to apply cable exit, which can provide the right angle exit to the coaxial cable 160, as shown in FIG. 13, without the need of the ferrule provided by other prior art designs. Moreover, the cable exit 16, can be applied after the cable 160 is terminated, which also adds to the simplicity in that the cable exit need not be applied by application tooling. Other possible embodiments are also possible as described below.

With reference now to FIGS. 14-20 a second embodiment of the coaxial plug assembly is shown at 403. It should be appreciated in this embodiment that the coaxial plug connector 12 as well as the main housing portion 10 are identical to that shown in the embodiment of FIG. 1-13, but that retention housing 414, and cable exit member 416 are modified from corresponding retention housing 14 and cable exit member 16.

Figures 16, 17:
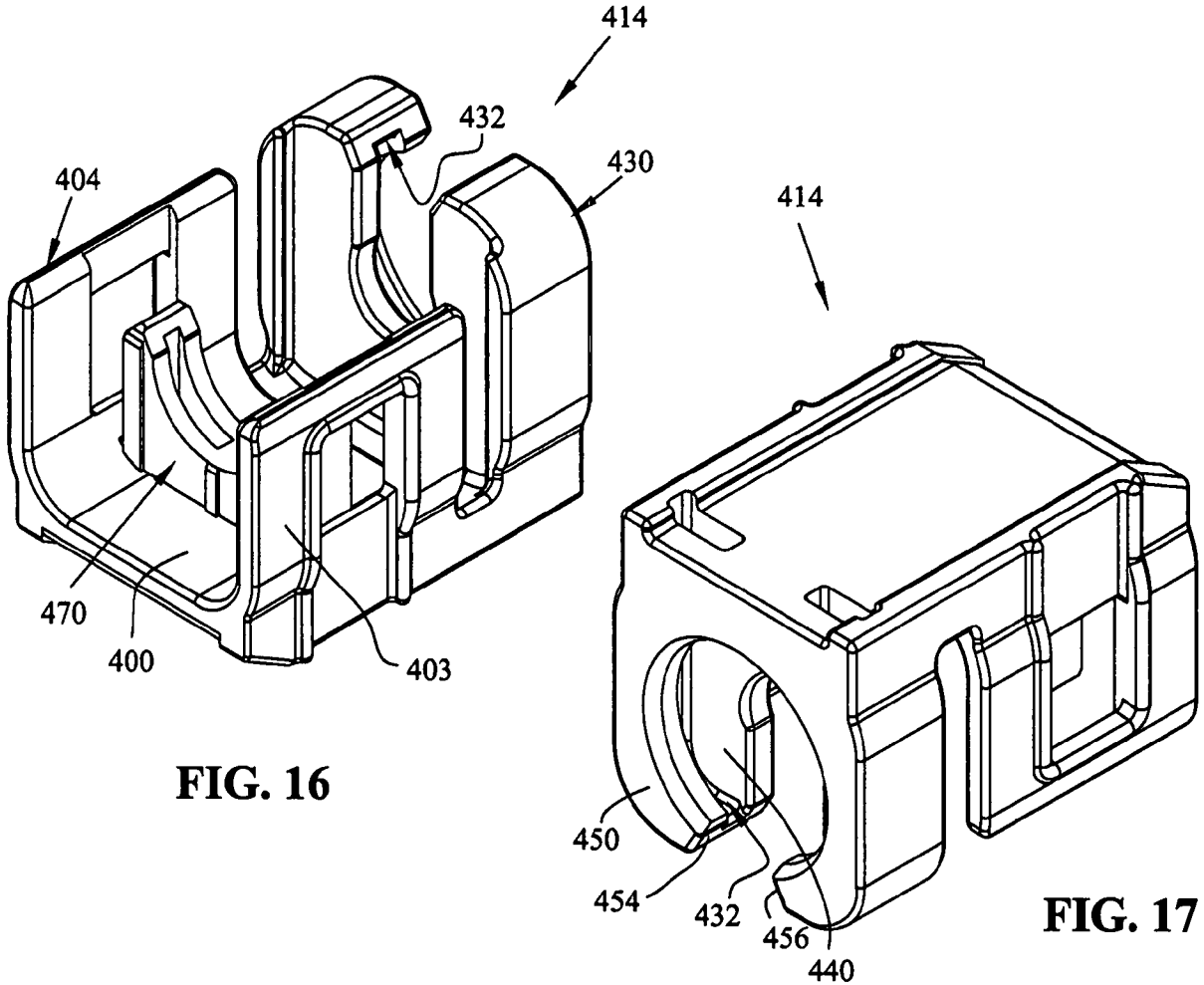
FIGS. 16 and 17 are upper and lower perspective views respectively of the retention housing of the embodiment of FIG. 14.

As shown in FIGS. 16 and 17, the retention housing 414 is similar to that shown in FIGS. 7 and 8, and generally includes a lower wall section 400, upstanding wall sections 403 and 404 and terminal locking mechanism 470, but that rear locking plate portion 430 is modified. In particular, channel 432 is not U-shaped but rather is of a circular cross section (FIG. 17) and is defined by inner wall 440 and outer wall 450 with lead in surfaces 454 and 456.

Figure 19:
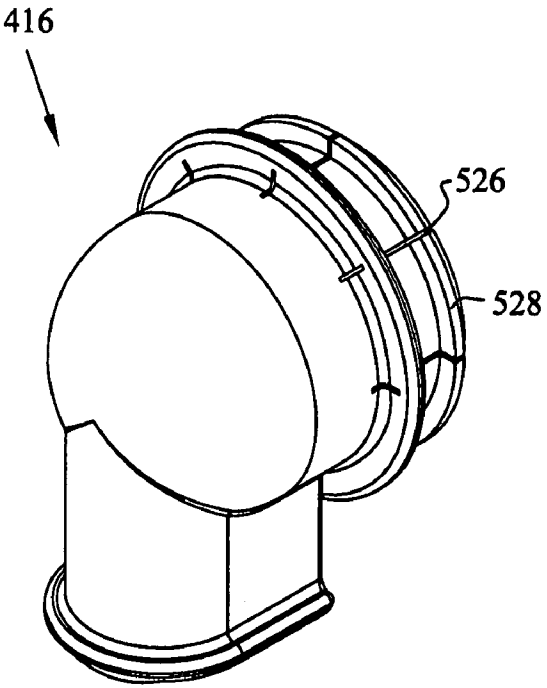
FIGS. 18 and 19 are upper and lower perspective views respectively of the cable exit member of the embodiment of FIG. 14.
Figure 18:
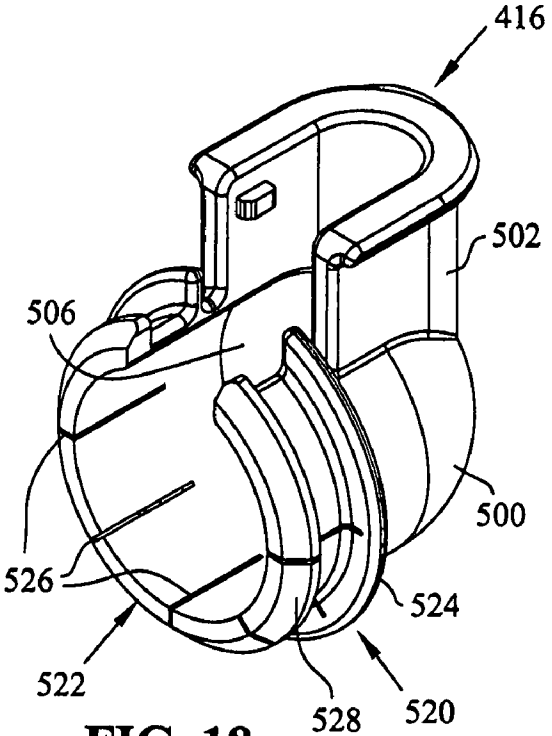

Meanwhile, as shown in FIGS. 18 and 19, cable exit member 416 includes a dome shaped portion 500 having an exit sleeve 502 which defines a right angled cable slot 506. Cable exit member 416 includes a flange 520 defined by a resilient wall 522 and a fixed wall 524. Resilient wall 522 includes a plurality of slits 526 which define resilient finger portions 528.

Figure 20:
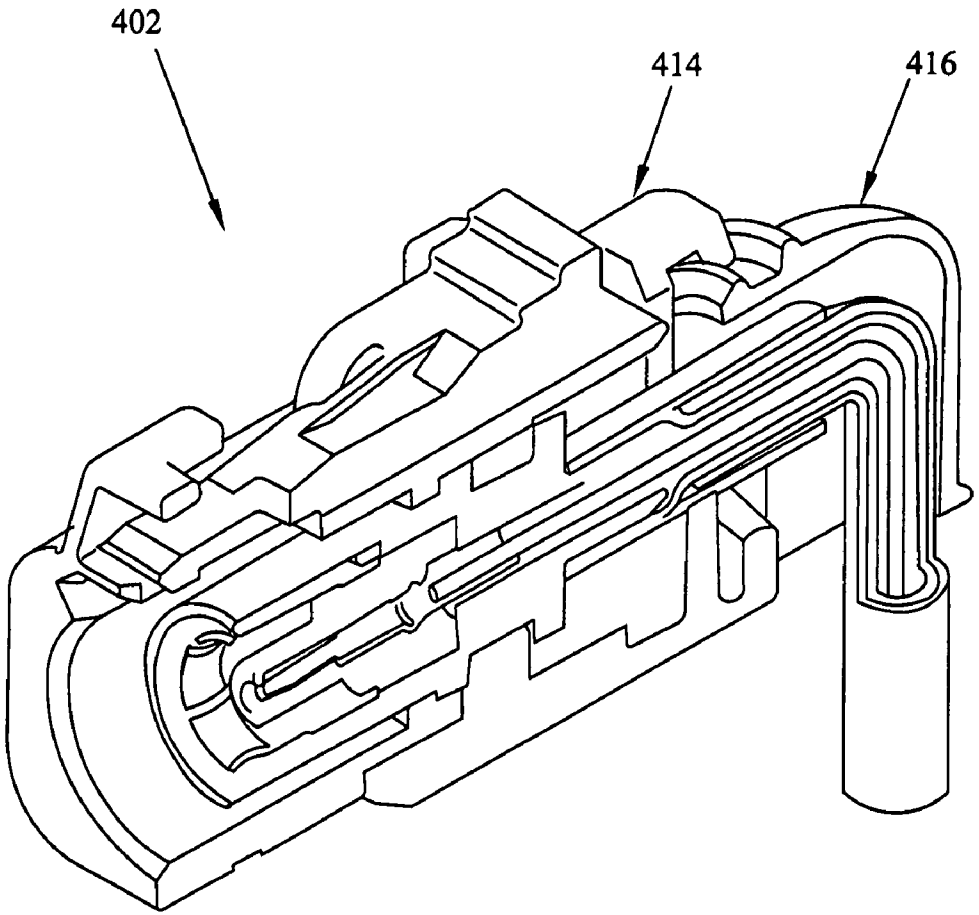
FIG. 20 is a cross sectional view through lines 20-20 of FIG. 14.

With reference now to FIG. 20 it should be appreciated that the coaxial plug assembly 402 functions in much the same fashion as coaxial plug assembly 2 but rather cable exit member 416 is locked in place with the corresponding retention housing 414 by way of a resilient wall 522 snap fitting within its corresponding opening 432.

Figure 21:
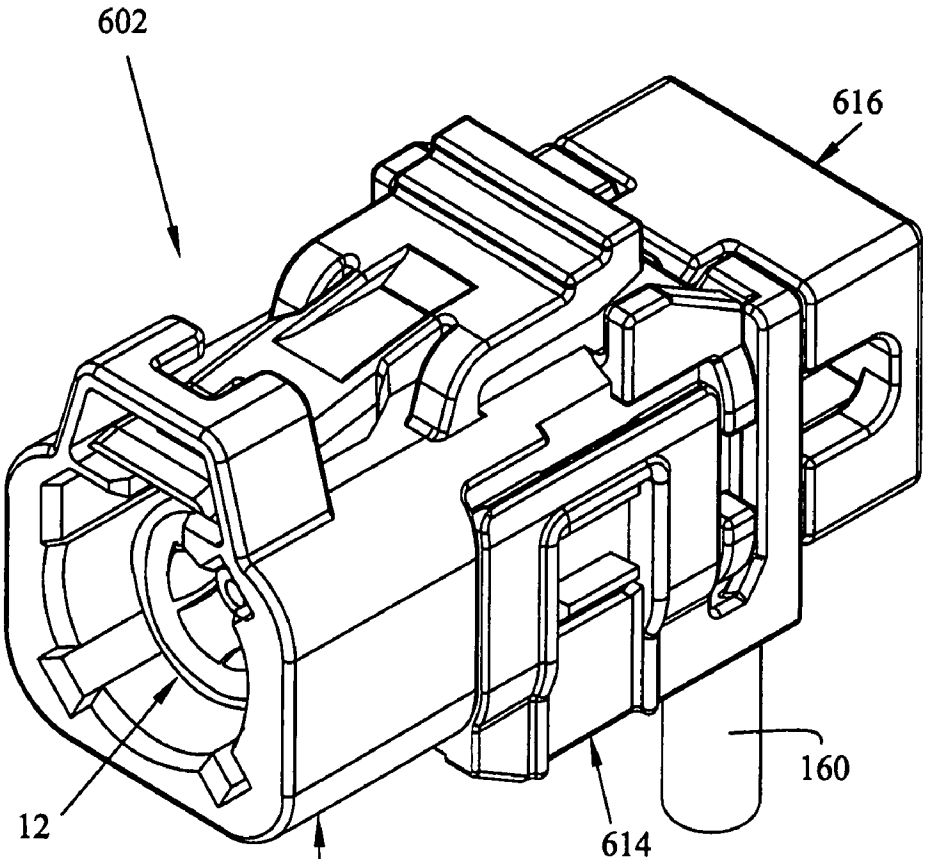
FIG. 21 is a front perspective view of a third embodiment of the present disclosure.
Figure 22:
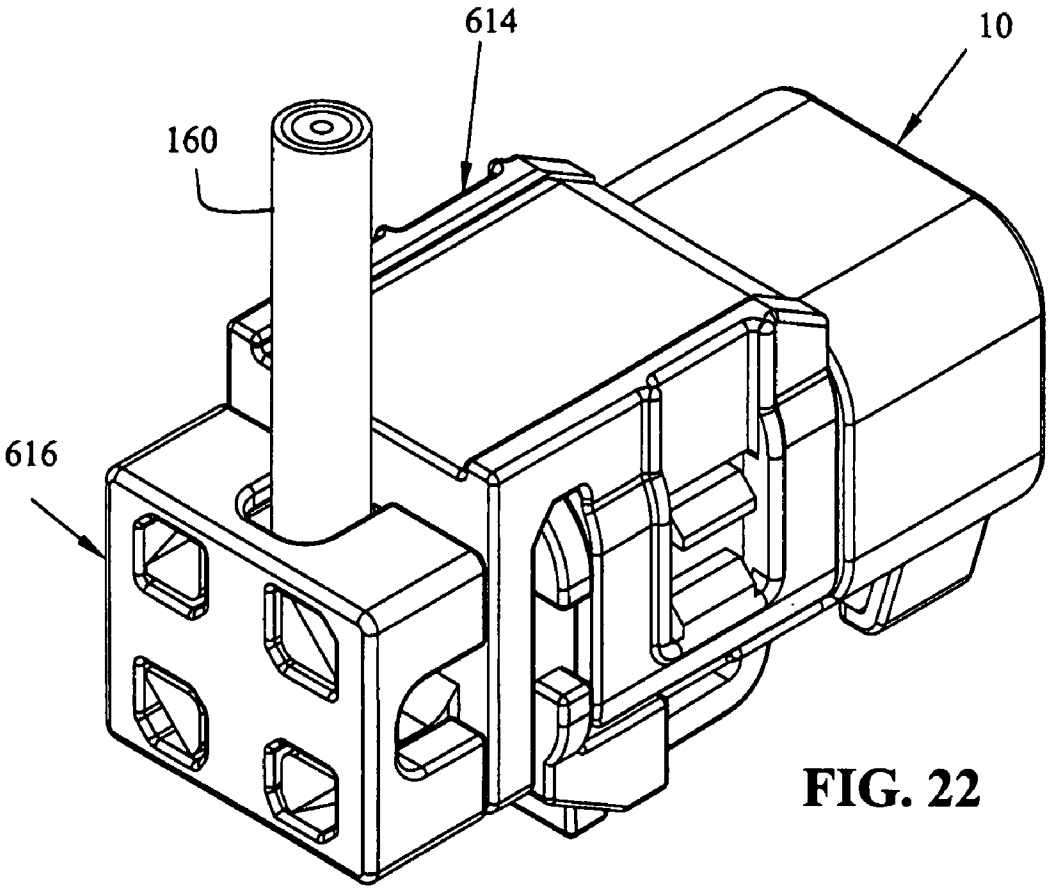
FIG. 22 is a rear lower perspective view of the embodiment of FIG. 21.

With reference now to first to FIGS. 21 and 22 a third embodiment of the invention is shown at 602. In this embodiment, as in the embodiment of FIG. 14, the main housing portion 10 and coaxial plug contact 12 are identical. However in this embodiment, a new retention housing 614 and cable exit member 616 are provided.

Figure 24:
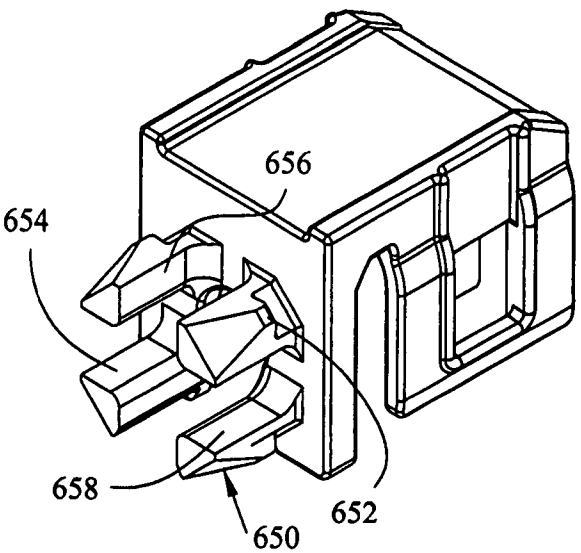
FIGS. 23 and 24 are top and bottom perspective views of the retention housing of the embodiment of FIG. 21.
Figure 23:
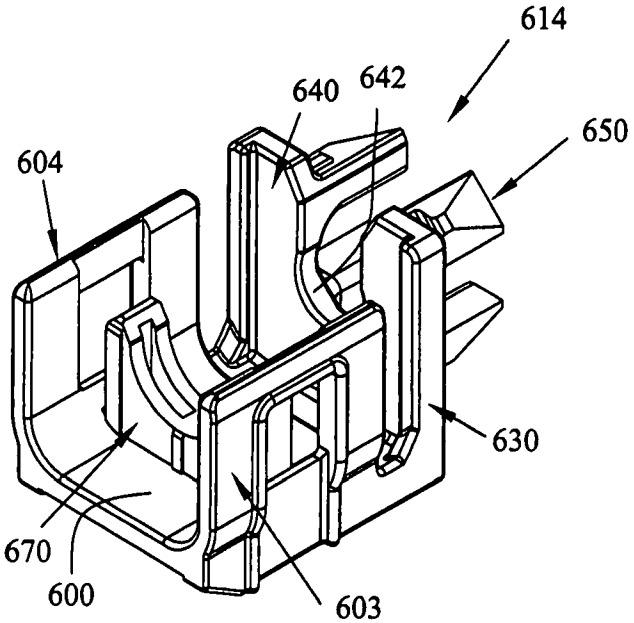

As best shown in FIGS. 23 and 24, the retention housing 614 will be described. The retention housing 614 includes a lower wall section 600 having upstanding walls 603 and 604 much like the previous embodiment. This housing 614 also includes a terminal locking mechanism 670 upstanding from wall section 600. Retention housing 614 also include a rear locking plate portion at 630 and integrally attached to wall section 600. The locking plate portion 630 has an inner wall portion 640 defining a U-shaped slot 642. Retention housing 614 further includes longitudinally extending locking arms 650 which include diagonally oriented latching surfaces at 652, as best shown in FIG. 24. The locking arms 650 define three orientation slots for a cable, namely slot 654, 656 and 658, as best shown in FIG. 24.

Figure 26:
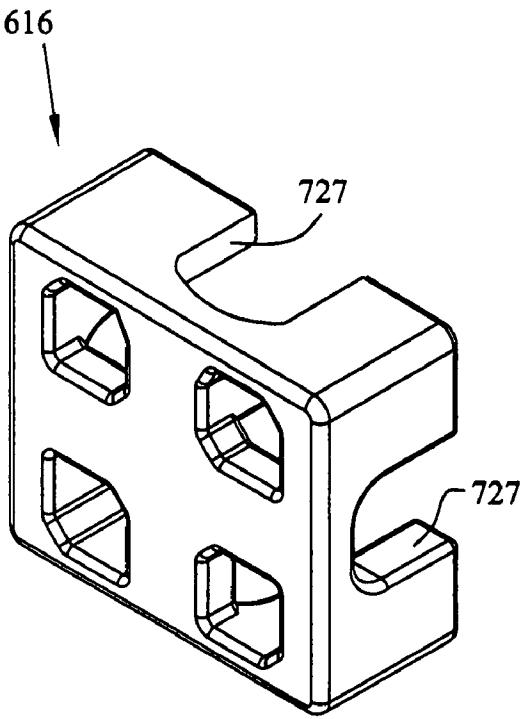
FIGS. 25 and 26 are top and bottom perspective views of the cable exit member of the embodiment of FIG. 21.
Figure 25:
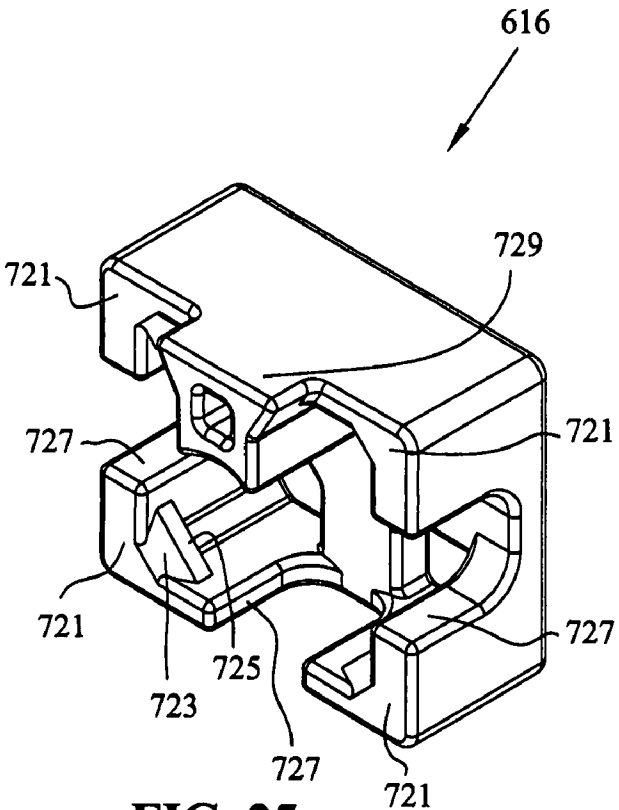

With respect now to FIGS. 25 and 26, cable exit member 616 is provided with corner posts 721 having angularly disposed latching members 723 which defines a rearwardly directed latching surface 725. As shown in FIG. 25, the cable exit member 616 is generally rectangular in shape and includes three cable exit openings 727 on three of the side walls and an orienting lug 729 on the remaining wall.

With reference again to FIG. 22, the retention housing 614 is operated in a similar manner as it relates to its engagement with the main housing portion 10 and the use of the terminal locking mechanism 670 to hold the coaxial plug connector 12 in position. However in order to provide the exit angle of the coaxial cable 160 at the proper orientation the cable is routed through one of the cable exit openings 654, 656 and 658, and through one of the corresponding slots 727 in the cable exit member 616. The cable exit member 616 is snapped to the retention housing by way of the latching surfaces 725 engaging with the surfaces 652 of the longitudinal extending locking arms 650, as shown in FIG. 22.

Figure 27:
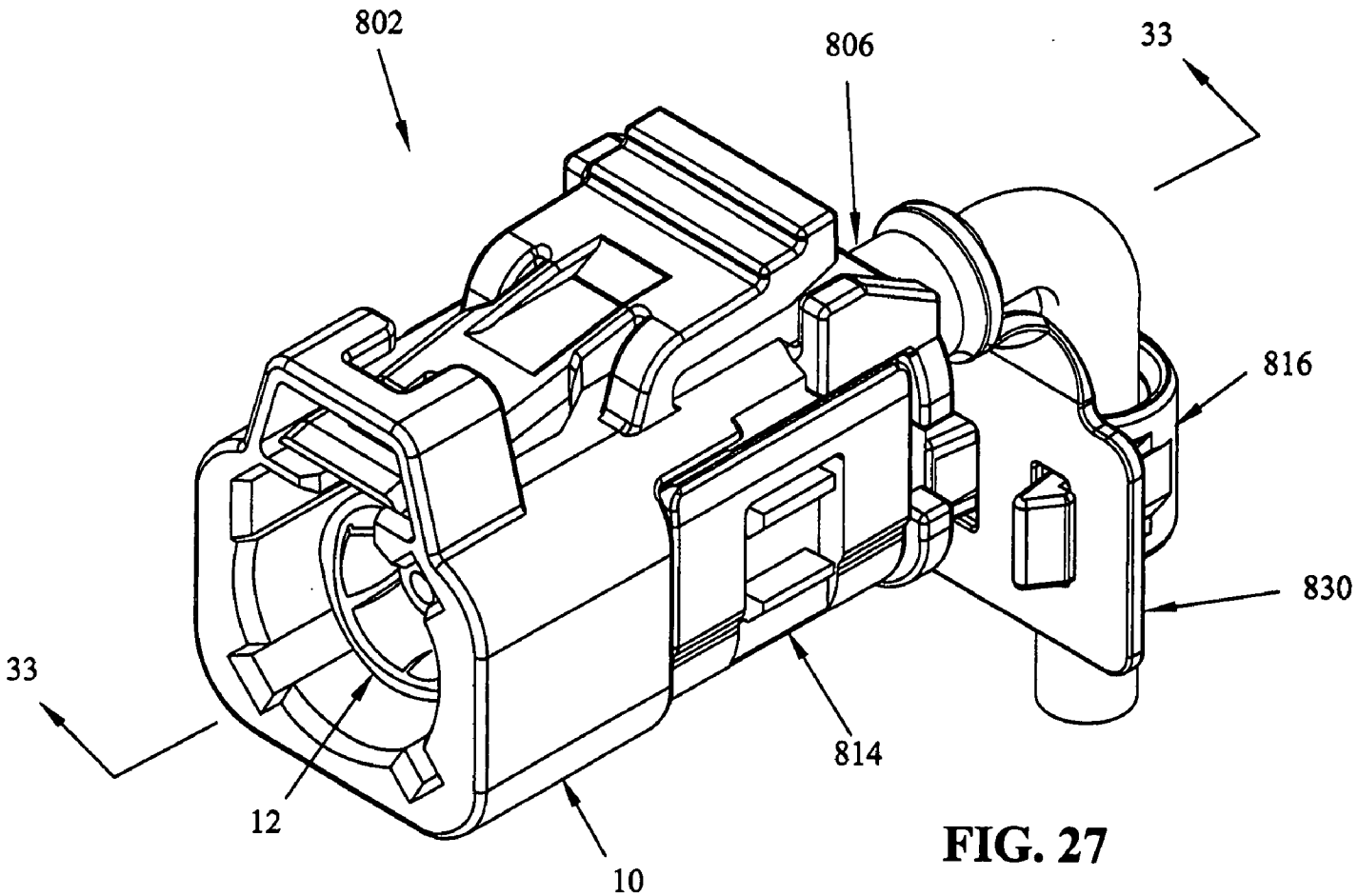
FIG. 27 is a top perspective view of yet another embodiment.
Figure 28:
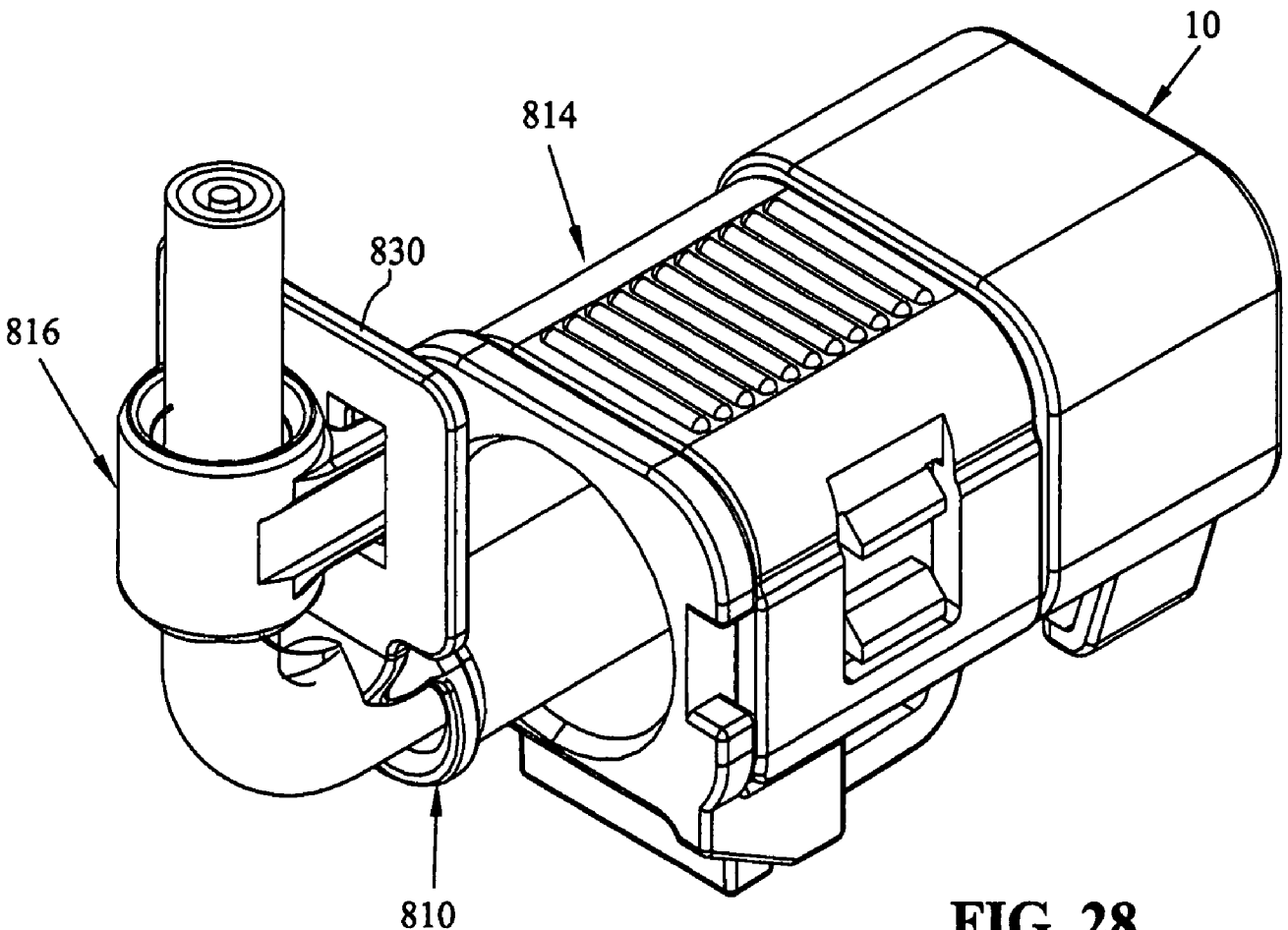
FIG. 28 is a bottom perspective view of the embodiment of FIG. 27.

With respect now to FIGS. 27 and 28, a fourth embodiment of the invention will be described. As in the other three embodiments, the main housing portion 10 and coaxial plug connector 12 are identical. In this embodiment, a modified retention housing 814 and cable exit member 816 are provided. In this embodiment, a modified locking plate 830 is integrally connected to modified ferrule 806 to which cable exit member 816 is locked.

Figure 30:
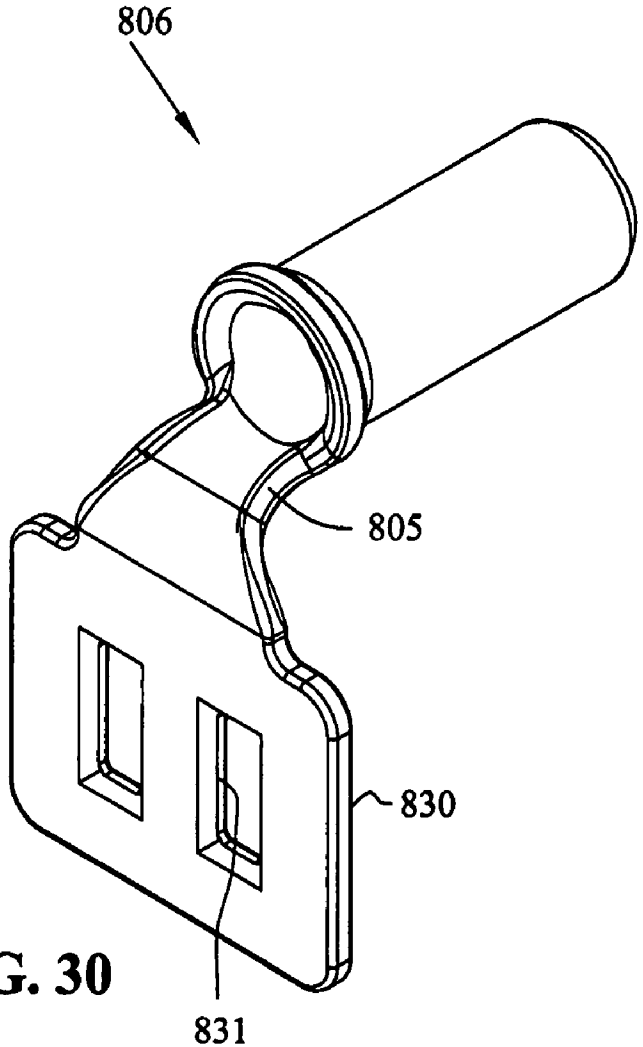
FIGS. 29 and 30 are perspective views of the modified locking ferrule.
Figure 29:
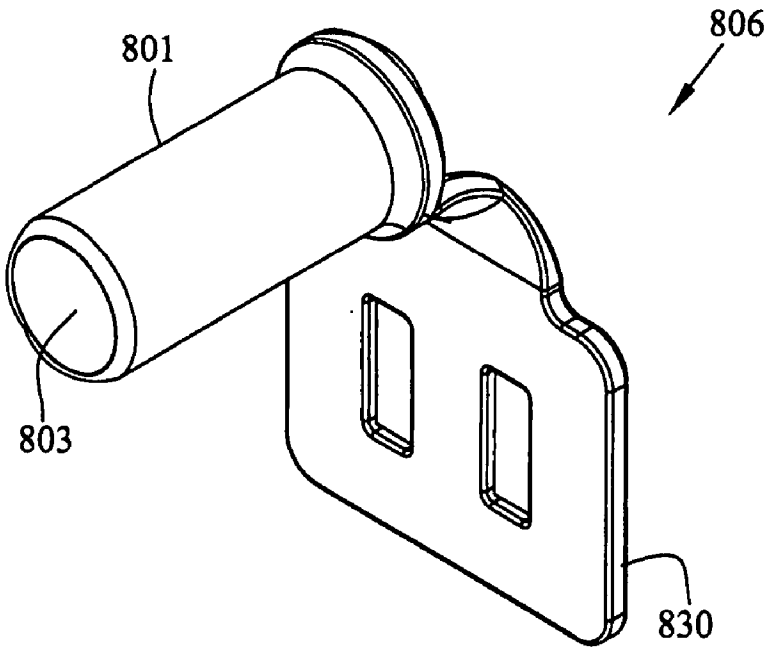

With respect now to FIGS. 29 and 30 modified ferrule 806 includes a front sleeve 801 having a cable receiving opening at 803. Meanwhile rear locking plate portion 830 is attached to the front sleeve 801 by way of an integral neck 805 to position the locking plate portion 830 in a perpendicular plane to that of front sleeve 801. Locking plate 830 includes apertures 831.

Figure 32:
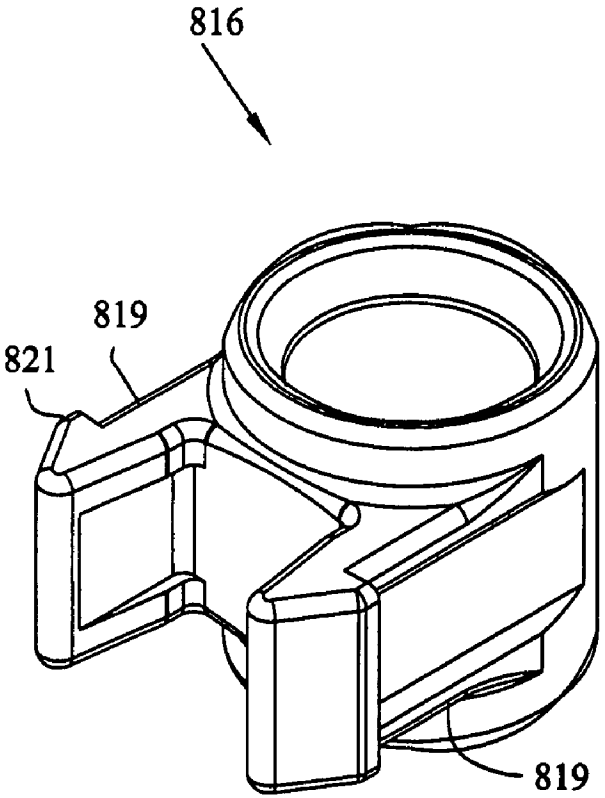
FIGS. 31 and 32 are perspective views of the cable exit member for the present embodiment.
Figure 31:
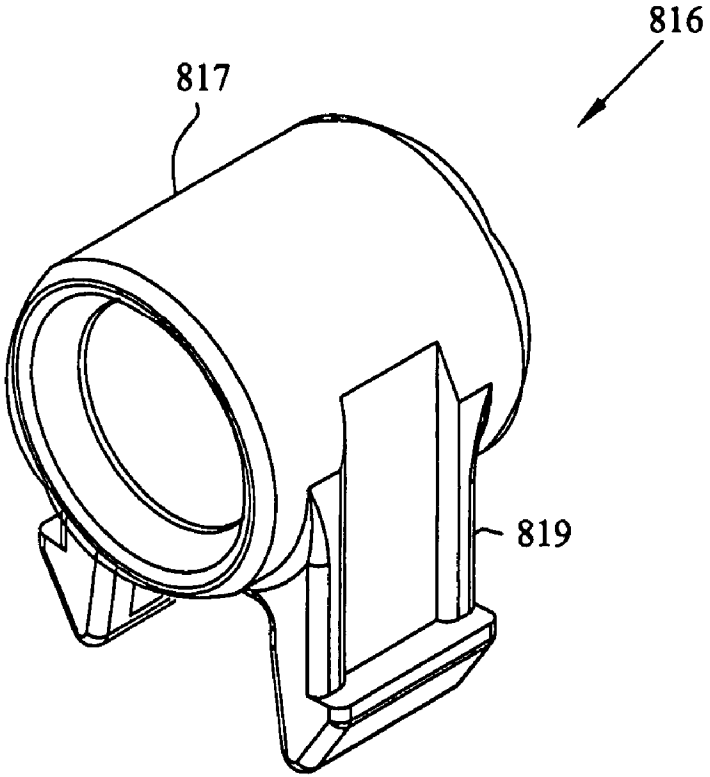

With respect now to FIGS. 31 and 32, cable exit member 816 includes a generally cyclical barrel portion 817 having integral locking legs 819 extending therefrom. Locking legs 819 include locking lugs 821 for lockingly engaging in the apertures 831 as described below.

Figure 33:
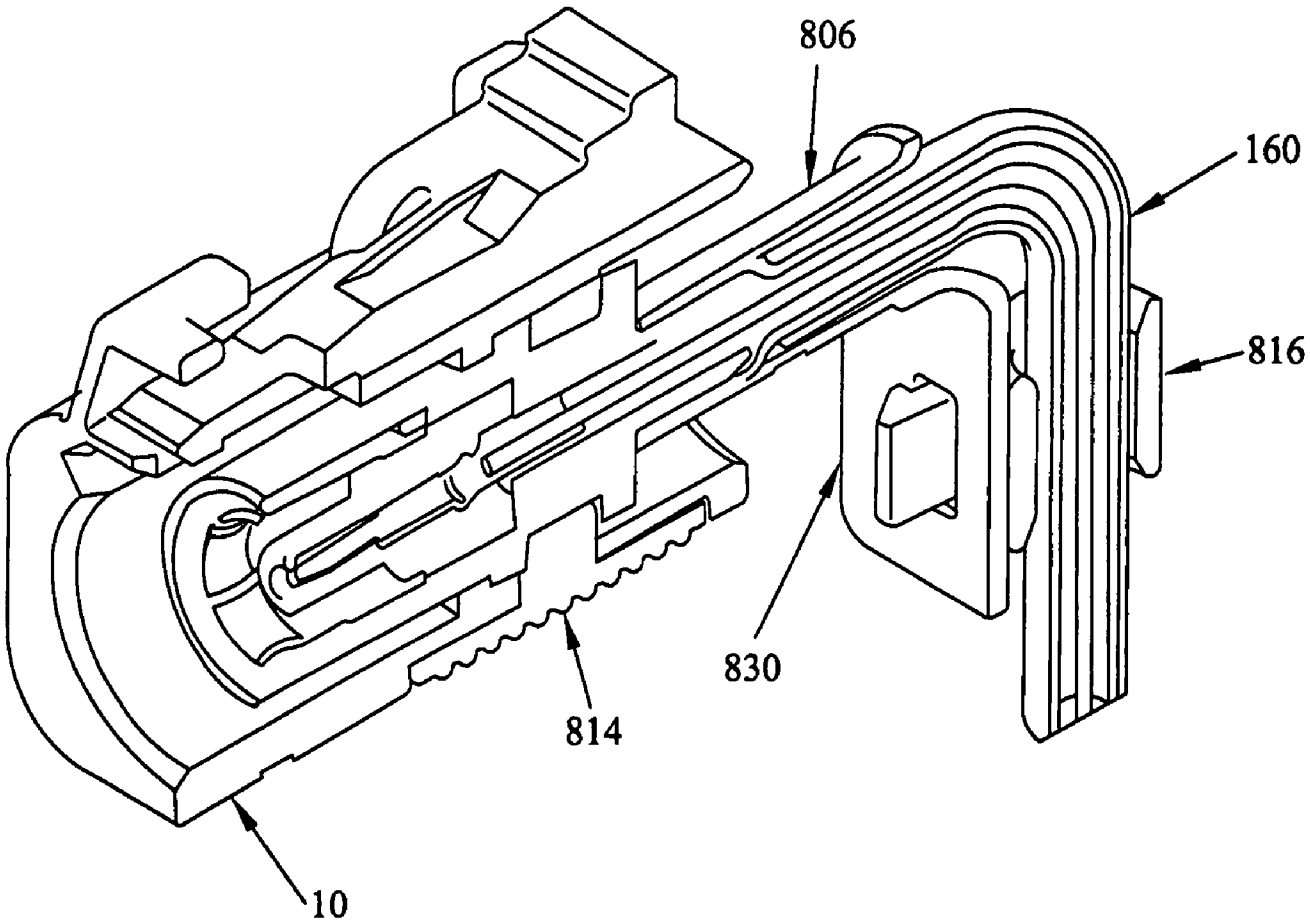
FIG. 33 is a cross-sectional view through lines 33-33 of FIG. 27.

With reference now to FIG. 33, the coaxial plug assembly 802 will be assembled in a manner similar to that described with reference to FIG. 1 whereby the sleeve 801 is crimped over the cable sheath which will position locking plate in the transverse position shown in FIG. 33. It should be appreciated that the cable exit member 816 will be slidably received over coaxial cable 160 prior to its termination, and can now be latched in place to the locking place again as shown in FIG. 33.

What is claimed is:

1. An electrical connector assembly for interconnection to a cable, comprising:

a main housing assembly having a front mating face and a conductor receiving face;

a locking plate adjacent to said conductor receiving face; and a cable exit member profiled to re-direct the cable to an angle other than an exit angle at the conductor receiving face, said cable exit member having inner open walls defining a cable receiving slot, and said cable exit member being attachable to said locking plate in a snap-fit manner, whereby said cable can be terminated to said connector, and said cable exit member can be installed to the locking plate, over the terminated cable, with the cable received in the cable receiving slot.

2. The electrical connector of claim 1, wherein said housing assembly is comprised of first and second housing portions.

3. The electrical connector of 2, wherein said locking plate is integrated with one of said housing portions.

4. The electrical connector of claim 1, wherein said locking plate is defined by an opening to receive the cable exit member.

5. The electrical connector of claim 4, wherein said cable exit member is defined as an elbow with an attachment flange at one end thereof.

6. The electrical connector of claim 5, wherein said opening has a U-shaped channel profiled to receive transversely said attachment flange.

7. The electrical connector of claim 6, wherein said flange is circular, and said channel is U-shaped, with a radius of curvature at a closed end, approximating a radius of said attachment flange, whereby said flange can rotate within said channel.

8. The electrical connector of claim 6, wherein said channel is wider than said attachment flange at the open end.

9. The electrical connector of claim 6, wherein said channel is narrower than said attachment flange at the open end, to provide said snap fit attachment.

10. The electrical connector of claim 1, wherein said cable exit member is generally rectangular in configuration, with cable exit openings along at least some of the sides thereof.

11. The electrical connector of claim 10, wherein said locking plate includes longitudinally extending locking arms.

12. The electrical connector of claim 11, wherein said locking plate includes four longitudinally extending locking arms, with a spacing between adjacent locking arms, coinciding with said cable exit openings.

13. The electrical connector of claim 1, wherein said locking plate is attached to a ferrule, said ferrule being crimped to said cable.

14. The electrical connector of claim 13, wherein said cable exit member is a cylindrical member latched to said locking plate.

15. An electrical connector assembly for interconnection to a cable, comprising an insulating housing assembly having a front mating face and a conductor receiving face, a locking plate attached to said housing assembly adjacent to said conductor receiving face, the locking plate extending in a generally transverse direction relative to a mating direction of the connector assembly, and a cable exit member, removably attachable to said locking plate and profiled to re-direct the cable in multiple angular exit orientations.

16. The electrical connector of claim 15, wherein said cable exit member is rotatable relative to said locking plate to re-direct the cable in multiple angular exit orientations.

17. The electrical connector of claim 15, wherein said cable exit member is fixed relative to said locking plate, and includes plural cable exit openings to re-direct the cable in multiple angular exit orientations.

18. The electrical connector of claim 17, wherein said cable exit member is generally rectangular in configuration, with cable exit openings along at least some of the sides thereof.

19. The electrical connector of claim 18, wherein said locking plate includes longitudinally extending locking arms.

20. The electrical connector of claim 19, wherein said locking plate includes four longitudinally extending locking arms, with a spacing between adjacent locking arms, coinciding with said cable exit openings.

* * * * *